US006261137B1

(12) United States Patent
Wilcox

(10) Patent No.: US 6,261,137 B1
(45) Date of Patent: Jul. 17, 2001

(54) CONDUCTOR CONNECTION SYSTEM

(75) Inventor: Martin Allen Wilcox, Springdale, AR (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 09/304,821

(22) Filed: May 5, 1999

(51) Int. Cl.[7] ..... H01R 4/10
(52) U.S. Cl. ..... 439/877; 174/84 C
(58) Field of Search ..... 439/877, 880, 439/881, 882; 174/40 CC, 73.1, 84 C, 84 R

(56) References Cited

U.S. PATENT DOCUMENTS

| | | | | |
|---|---|---|---|---|
| 2,895,195 | * | 7/1959 | Ehmann | 403/212 |
| 3,596,231 | * | 7/1971 | Melton | 439/426 |
| 3,626,363 | * | 12/1971 | McIver | 439/880 |
| 3,761,872 | * | 9/1973 | Ebinger | 439/882 |
| 3,916,517 | | 11/1975 | Luongo | 29/874 |
| 3,944,721 | | 3/1976 | Reeder | 174/88 R |
| 3,996,417 | | 12/1976 | Annas | 174/90 |
| 4,165,148 | | 8/1979 | Campbell et al. | 439/880 |
| 4,350,843 | | 9/1982 | Campbell et al. | 174/94 R |
| 4,940,856 | | 7/1990 | Bock | 174/94 R |
| 4,950,838 | | 8/1990 | Gordon | 174/94 R |
| 5,396,033 | | 3/1995 | Piriz et al. | 174/94 R |
| 5,445,535 | | 8/1995 | Phippips, Jr. et al. | 439/394 |
| 5,499,934 | | 3/1996 | Jacobsen et al. | 439/585 |
| 5,635,676 | | 6/1997 | Piriz | 174/84 C |
| 5,658,163 | * | 8/1997 | DeRoss | 439/424 |

OTHER PUBLICATIONS

Kearney Taps, Terminals, and Splices Catalog; Section 141, 142, 143 Aug. 1996.

* cited by examiner

*Primary Examiner*—Lincoln Donovan
*Assistant Examiner*—Son V. Nguyen
(74) *Attorney, Agent, or Firm*—Fish & Richardson PC

(57) ABSTRACT

A conductor connector includes a generally tubular connector body having a non-uniform wall thickness and defining a central bore extending from a first end of the body. The connector also includes at least one groove passing along an exterior surface of the body. The groove has a pair of side edges and a base edge.

41 Claims, 3 Drawing Sheets

FIG. 1
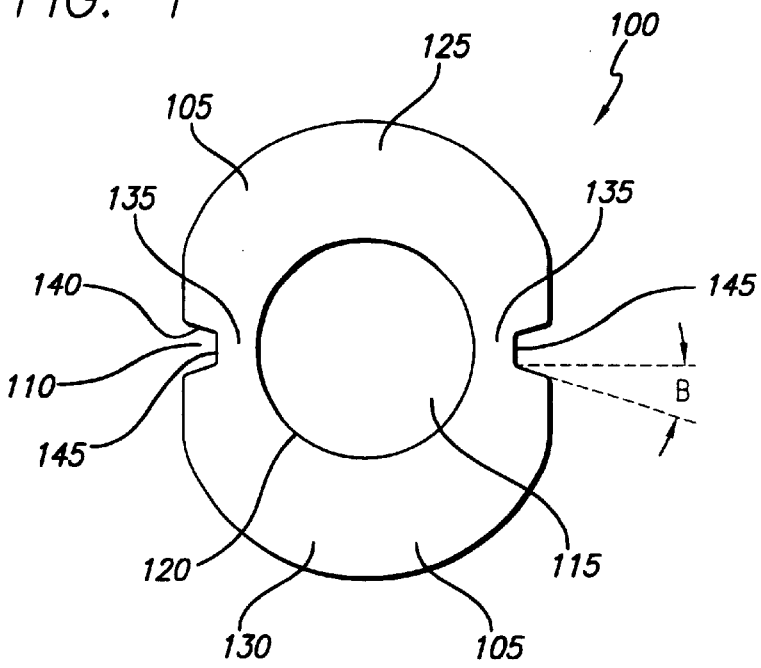
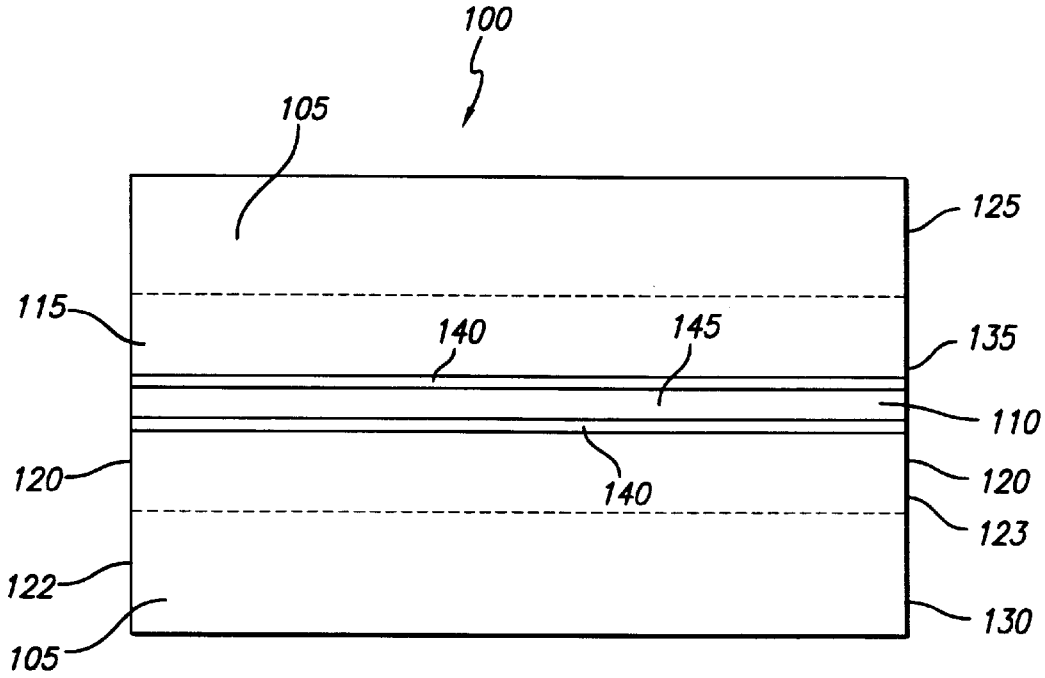
FIG. 2

FIG. 3
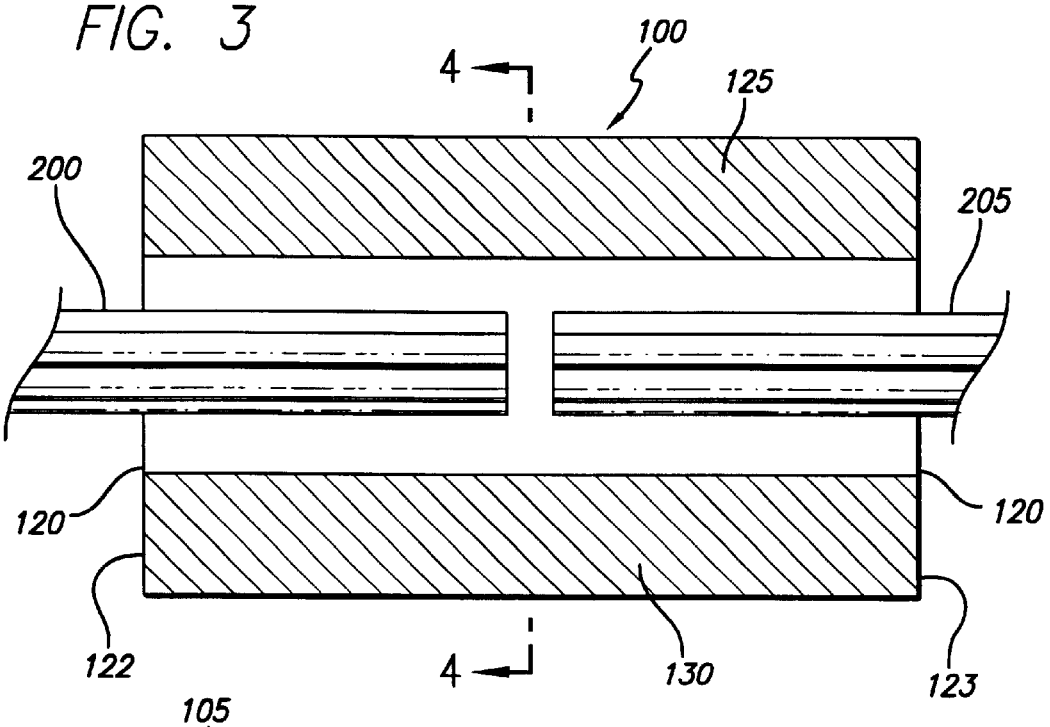
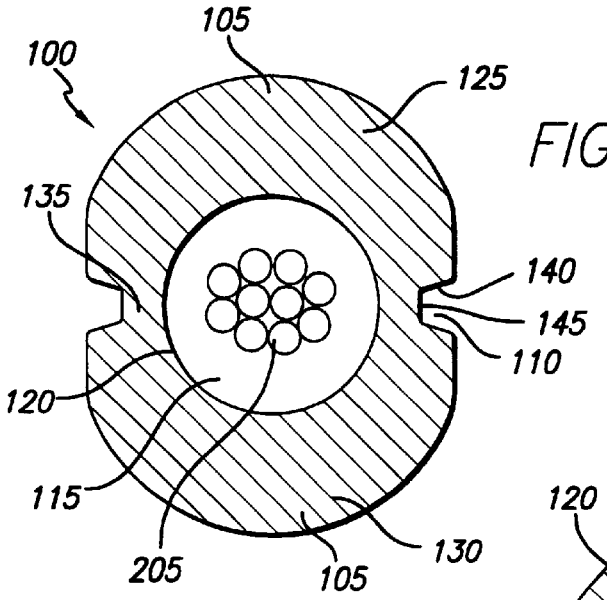
FIG. 4
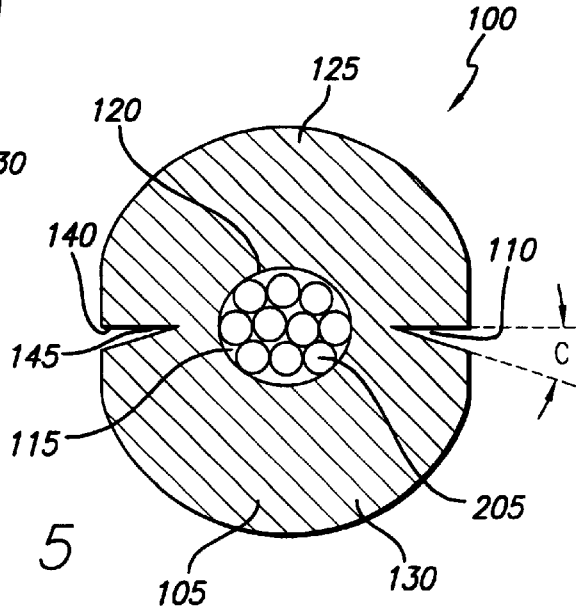
FIG. 5

CONDUCTOR CONNECTION SYSTEM

TECHNICAL FIELD

The invention relates to a conductor connection system.

BACKGROUND

A conductor connection system joins two conductors, which may be wires, cables, or contacts. Typical connectors of such a system include one or two channels into which the conductors are inserted.

A conventional single channel connector consists of a metal tube having a central bore. To connect two conductors, an end of a first conductor is inserted into one end of the metal tube and that end of the tube is crimped around the first conductor to secure the conductor. The same procedure is used to secure a second conductor in the connector.

Connectors of different bore diameters are provided for connection to conductors of different outer diameters. The bore diameter of the connector must be larger than the outer diameter of the conductor so that the conductor will fit in the connector, but must be small enough to provide a good fit between the crimped connector and the conductor.

A conventional two channel connector has the two channels arranged in parallel and separated by a metal wall. Each channel has an opening running along its length. To connect two conductors, an end of a first conductor is inserted into one of the channels so that the conductor extends along the entire length of the channel. That channel is then crimped around the conductor to secure the conductor. The same procedure is used to secure a second conductor in the other channel. This results in the two conductors being parallel to each other for at least the length of the channels.

To accommodate different conductor diameters, two channel systems are available in different sizes. The sizes vary based on the diameter of the closed channel. A conventional two channel connector can be configured to connect two different sized conductors by fabricating the connector so that the channels have different closed diameters.

Specialized tools, such as installation tools and crimping dies, are used to crimp the connectors around the conductors. The tools are sized to match their corresponding connectors so that each connector size typically requires a corresponding set of tools.

SUMMARY

In one general aspect, a conductor connector includes a generally tubular connector body having a non-uniform wall thickness and defining a central bore extending from a first end of the body. At least one groove is defined along an exterior surface of the body by a pair of side edges and a base edge.

Embodiments may include one or more of the following features. For example, the conductor connector may include a second groove positioned opposite the first groove. A third groove may be positioned adjacent to the first groove and a fourth groove may be positioned adjacent to the second groove. A wall thickness above and below the groove may be greater than the thickness in regions adjacent to the groove. The side edges may be parallel. An angle formed between the side edges and the base edge may be a right angle or an obtuse angle, such as an angle of approximately 106 degrees.

The conductor connector may further include a first conductor inserted into the central bore from one end of the body and a second conductor inserted into the central bore from a second end of the body. The connector may be crimped to retain the first conductor and the second conductor. The connector may be sized to secure conductors ranging in size from a first size having a first cross-sectional area to a second size having a second cross-sectional area 40% or more larger than that of the first size. For example, a connector may secure conductors having diameters ranging from 0.128 inches to 0.258 inches, for a cross-sectional area difference of 306%.

The connector also may include a terminal contact portion attached to the generally tubular connector body at a second end that is opposite the first end of the body. When the connector is so configured, a single conductor is inserted into the bore from the first end.

In another general aspect, a first conductor is terminated or spliced to a second conductor by providing a connector, a first conductor, and a second conductor. The connector includes a generally tubular connector body having a non-uniform wall thickness, defining a central bore extending from a first end of the body, and having at least one groove defined along an exterior surface of the body by a pair of side edges and a base edge. The first conductor is inserted into the central bore from one end of the body and the second conductor is inserted into the central bore from the second end of the body. The connector is crimped to the conductors.

The connector provides considerable advantages, such as permitting a particular connector to be used with conductors having a range of different sizes. This flexibility reduces the number of connectors and supporting tools (e.g., installing tools and crimping dies) needed to provide splicing and termination connections for a given set of conductor sizes, such as conductors ranging in size from #8 Solid AWG to 1033 MCM Stranded. Moreover, the connector has one or more grooves that provide stress relief to prevent damage to the conductors. A considerable benefit also results from the ability to fabricate the connector through the use of aluminum extrusion, rather than cold heading and tube draw dies.

Other features and advantages will be apparent from the following description, including the drawings, and from the claims.

DESCRIPTION OF THE DRAWINGS

FIG. 1 is a front view of a conductor connector.

FIG. 2 is a side view of the conductor connector of FIG. 1.

FIG. 3 is a cross-sectional side view of a pair of conductors inserted into the uncrimped conductor connector of FIG. 1.

FIG. 4 is a cross-sectional front view of the uncrimped conductor connector along section 4—4 of FIG. 3.

FIG. 5 is a cross-sectional front view of the conductor connector of FIG. 4 after crimping.

DESCRIPTION

Figure 6:
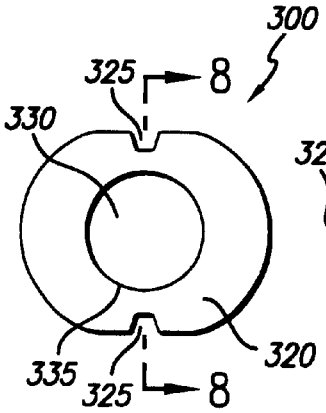
FIG. 6 is a front view of a conductor connector having a terminal.

Referring to FIGS. 1 and 2, an electrical connector 100 that is generally oval in shape includes a generally tubular wall 105 having a non-uniform thickness and a pair of grooves 110. Wall 105 defines a circular central bore 115, which passes between a pair of openings 120 on opposite ends 122 and 123 of the connector. The central bore 115 has a constant diameter along its length.

The thickness of wall 105 varies from a maximum thickness at an upper region 125 and a lower region 130 to a minimum thickness at middle regions 135 in which the grooves 110 are defined. The thickness at upper region 125 and lower region 130 may, for example, be approximately 0.24 inches, and the thickness of the middle regions 135 may be approximately 0.073 inches. Grooves 110 are defined by a pair of side edges 140 and a base edge 145. Side edges 140 may be parallel to each other or may form an obtuse angle with respect to the base edge 145. As depicted in FIG. 1, for exemplary purposes, side edges 140 are angled at an uncrimped angle B, with respect to a line perpendicular to base edge 145. Uncrimped angle B may be, for example, approximately 16° with respect to that line (or an obtuse angle of approximately 106° with respect to base edge 145). The grooves may have a depth of, for example, approximately 0.068 inches.

The connector 100 is made by extrusion followed by deburring of the openings 120 and other edge surfaces. The connector may be made of a metal, such as aluminum or copper.

Referring to FIGS. 3–5, to splice a first conductor 200 to a second conductor 205, the conductors 200 and 205 are inserted into central bore 115 through openings 120. Conductors 200 and 205 may have the same size diameters or different diameters. To ensure optimum retention after crimping, conductors 200 and 205 should extend along the entire length of central bore 115.

The conductors 200 and 205 are crimped within connector 100 by placing a splicing tool having an appropriately sized crimping die (not shown) around the connector and compressing upper region 125 and lower region 130 together. The grooves 110 are filled with material from middle regions 135 that is displaced when those regions are flattened by the compression of regions 125 and 130. The amount of material from middle regions 135 that flows into grooves 110 will vary with the diameters of the conductors that are inserted into the central bore 115, since those diameters will determine the extent to which regions 125 and 130 can be compressed together. For example, if the conductors have relatively large diameters, such that regions 125 and 130 cannot be as closely compressed, the grooves will be less filled with material from middle regions 135 than if the conductors have relatively small diameters.

Compression of regions 125 and 130 will reduce the uncrimped angle B of side edges 140 to a crimped angle C. Crimped angle C may be as low as 0° if the diameters of the conductors are small relative to the diameter of the central bore 115. The crimped angle C may be close to the uncrimped angle B if the diameters of the conductors and the central bore 115 are relatively close.

A conductor connection system may include a set of connectors of different sizes. In general, the set includes fewer connectors than standard size conductors with which the system is designed to work. This is true because at least some of the connectors are designed for use with multiple conductor sizes. Table 1 illustrates a set of eight connectors that may be used to make connections to conductors ranging in size from #8 Solid AWG to 1033 MCM Stranded. The percentage variation in cross-sectional area of conductors associated with a particular connector also are shown in Table 1. For example, the "Size #1" connector has a percentage variation of 306%, which means that the largest conductor for use with that connector is 306% larger than the smallest conductor relative to the area of the smallest conductor. The percentage variation in area for the Size #1 connector is calculated as:

$$\begin{aligned}\text{Percentage Variation} &= (\text{Area of Largest} - \text{Area of Smallest})/\text{Area of Smallest} * 100\%,\\ &= [(\text{pi})(0.258/2)^2 - (\text{pi})(0.128/2)^2]/[(\text{pi})(0.128/2)^2] * 100\%,\\ &= 306\%.\end{aligned}$$

The percentage variation in area for the remaining connectors is calculated in the same manner and ranges from 138% to 11.9%.

TABLE I

Connector Size and Corresponding Wire Type and Diameter

| Connector Size | Wire Type and Diameter in Inches | Percentage Variation in Area |
|---|---|---|
| Size #1 | #8 Solid AWG - #2 Solid AWG 0.128 dia. - 0.258 dia. | 306 |
| Size #2 | #2 Solid AWG - 1/0-6/1 ACSR 0.258 dia. - 0.398 dia. | 138 |
| Size #3 | 1/0-6/1 ACSR - 4/0-6/1 ACSR 0.398 dia. - 0.563 dia. | 100 |
| Size #4 | 4/0-6/1 ACSR - 350 MCM Str. 0.563 dia. - 0.681 dia. | 46 |
| Size #5 | 350 MCM Str.-477-18/1 ACSR 0.681 dia. - 0.814 dia. | 42 |
| Size #6 | 477-18/1 ACSR - 750 MCM Str. 0.814 dia. - 0.998 dia. | 50 |
| Size #7 | 750 MCM Str.-795-26/7 ACSR 0.998 dia. - 1.108 dia. | 23 |
| Size #8 | 795-26/7 ACSR - 1033 MCM Str. 1.108 dia. - 1.172 dia. | 12 |

The conductor connection system may be used with a number of compression terminal types. These include one hole, two hole, four hole, slotted, captive bolt, stacking, adapters, pin, UL-listed, and tees. The compression terminals may be aluminum or copper.

Figure 7:
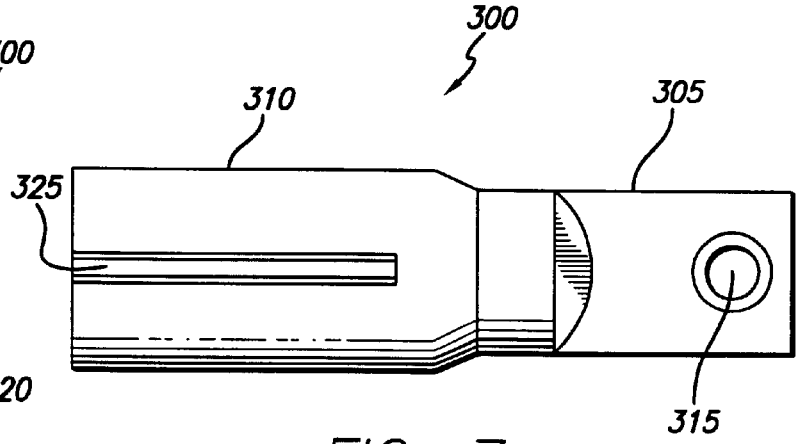
FIG. 7 is a side view of the conductor connector of FIG. 6.
Figure 8:
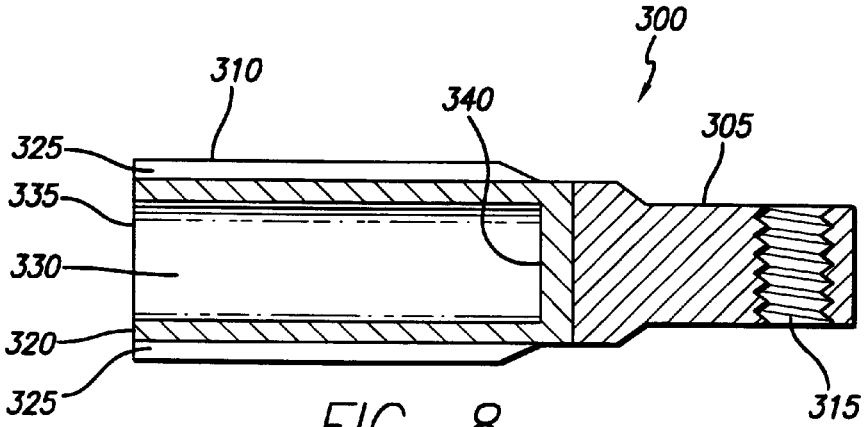
FIG. 8 is a cross-sectional side view of the conductor connector taken along section 8—8 of FIG. 6.

For example, referring to FIGS. 6–8, the conductor connection system may be used with a terminal connector 300 that includes a terminal contact portion 305 and a connector portion 310. The terminal contact portion 305 has a rectangular cross-section and includes a channel 315 passing completely through the portion 305. The channel 315 may be threaded or unthreaded. A circular pin may be substituted for the channel.

The connector portion 310 is generally oval in shape and includes a generally tubular wall 320 having a non-uniform thickness and a pair of grooves 325. Wall 320 defines a central bore 330 between an opening 335 and a closed end 340. The central bore 330 has a constant diameter along its length.

The terminal contact portion 305 and the connector portion 310 may be separately fabricated and joined using an inertia weld, friction weld, threads, press fit, orbital forming, or other mechanical joining method. The terminal contact portion may be made of a conductive material, such as an aluminum or copper alloy.

The terminal connector 300 is designed for use with multiple conductor sizes. For example, the terminal contact portion 305 may be used with the connectors listed in Table 1, above. Accordingly, the percentage variation in cross-sectional area of conductors associated with a particular terminal connector may range from approximately 12% to 306%.

The conductor connection system also may be used to make a number of compression splice types. These include tension, triplex, jumper, underground, repair, reducing, molded rubber products, and transformer stud adapters. The system also may be used with a number of service entrance sleeve types to provide power from the utility pole to the house.

Figure 9:
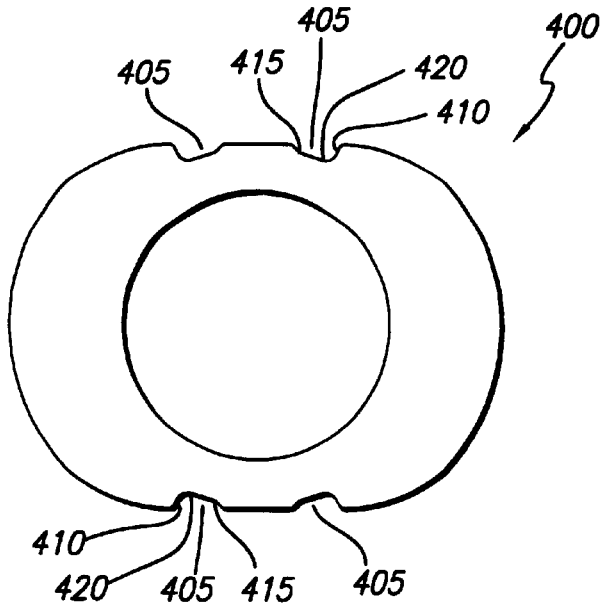
FIG. 9 is a front view of a conductor connector having four grooves.

Other embodiments are within the scope of the following claims. For example, connector 100 may be cast or machined. The connector also may be fabricated with only one groove 110. Referring to FIG. 9, a connector 400 may be fabricated with four grooves 405. Each groove may be defined by a first side edge 410, a second side edge 415, and a base edge 420. As depicted in FIG. 9, for exemplary purposes, side edges 410 and 415 have different lengths and are at different angles relative to the base edge 420.

What is claimed is:

1. A conductor connector comprising:

a tubular connector body having a non-uniform wall thickness and defining a central bore extending from a first end of the body; and at least one groove defined along an exterior surface of the body by a pair of side edges and a base edge;

wherein the connector body includes a first wall portion including and extending beyond the groove around a circumference of the tubular connector body and a second wall portion, wherein a thickness of the first wall portion beyond the groove for a distance longer than a width of the groove around the circumference of the connector body is constant and less than a thickness of the second wall portion.

2. The conductor connector of claim 1, further comprising a second groove positioned opposite the first groove.

3. The conductor connector of claim 2, further comprising a third groove adjacent to the first groove and a fourth groove adjacent to the second groove.

4. The conductor connector of claim 1, wherein a wall thickness above and below the groove is greater than a thickness in regions adjacent to the groove.

5. The conductor connector of claim 1, wherein the side edges are parallel.

6. The conductor connector of claim 1, wherein an angle formed between the side edges and the base edge is obtuse.

7. The conductor connector of claim 1, wherein an angle formed between the side edges and the base edge is a right angle.

8. The conductor connector of claim 1, wherein an angle formed between the side edges and the base edge is 106 degrees.

9. The conductor connector of claim 1, further comprising:

a first conductor inserted into the central bore from the first end of the body; and a second conductor inserted into the central bore from a second end of the body.

10. The conductor of claim 1, further comprising a terminal contact portion attached to the tubular connector body at a second end positioned away from the first end of the body.

11. The conductor connector of claim 1, wherein the connector is adapted to attach conductors ranging in cross-sectional area from a first smaller area to a second, larger area, and wherein the larger area is more than 40% larger than the smaller area.

12. The conductor connector of claim 11, wherein the larger area is more than 75% larger than the smaller area.

13. The conductor connector of claim 12, wherein the larger area is more than 100% larger than the smaller area.

14. The conductor connector of claim 13, wherein the larger area is more than 150% larger than the smaller area.

15. The conductor connector of claim 14, wherein the larger area is more than 300% larger than the smaller area.

16. The conductor connector of claim 1, wherein a thickness of the first wall portion is at least 50% less than a thickness of the second wall portion.

17. The conductor connector of claim 1, wherein the thickness of the first wall portion at points beyond the groove is less than the thickness of the second wall portion along the entire length of the central bore.

18. A connector for connecting two conductors in a splice or termination connection, the connector comprising:

a tubular connector body having a non-uniform wall thickness and defining a central bore extending from a first end of the body to a second end of the body, and a pair of grooves, wherein each groove is defined along an exterior surface of the body by a pair of side edges and a base edge and wherein each side edge defines an obtuse angle with the base edge to which the side edge is adjacent;

wherein the connector body includes a first wall portion including and extending beyond the groove around a circumference of the tubular connector body and a second wall portion, wherein a thickness of the first wall portion beyond the groove for a distance longer than a width of the groove around the circumference of the connector body is constant and less than a thickness of the second wall portion.

19. The connector of claim 18, wherein the connector is adapted to attach conductors ranging in cross-sectional area from a first, smaller area to a second, larger area, and wherein the larger area is more than 40% larger than the smaller area.

20. The connector of claim 19, wherein the larger area is more than 75% larger than the smaller area.

21. The connector of claim 20, wherein the larger area is more than 100% larger than the smaller area.

22. The connector of claim 21, wherein the larger area is more than 150% larger than the smaller area.

23. The connector of claim 22, wherein the larger area is more than 300% larger than the smaller area.

24. The conductor connector of claim 18, wherein a thickness of the first wall portion is at least 50% less than a thickness of the second wall portion.

25. The conductor connector of claim 18, wherein the thickness of the first wall portion at points beyond the groove is less than the thickness of the second wall portion along the entire length of the central bore.

26. A method of terminating or splicing a first conductor to a second conductor comprising:

providing a connector comprising a tubular connector body having a non-uniform wall thickness, defining a central bore extending from a first end of the body, and having at least one groove defined along an exterior surface of the body by a pair of side edges and a base edge, with the connector body including a first wall portion including and extending beyond the groove around a circumference of the tubular connector body and a second wall portion, wherein a thickness of the first wall portion beyond the groove for a distance longer than a width of the groove around the circumference of the connector body is constant and less than a thickness of the second wall portion;

providing a first conductor;

providing a second conductor;

inserting the first conductor into the central bore at the first end of the body;

inserting the second conductor into the central bore at a second end of the body, and crimping the connector to the conductors.

27. The method of claim 26, wherein the connector further comprises a second groove positioned opposite the first groove.

28. The method of claim 27, wherein an angle formed between the side edges and the base edge is 106 degrees.

29. The method of claim 26, wherein a wall thickness above and below the groove is greater than the thickness in regions adjacent to the groove.

30. The method of claim 26, wherein the side edges are parallel.

31. The method of claim 26, wherein an angle formed between the side edges and the base edge is obtuse.

32. The method of claim 26, wherein an angle formed between the side edges and the base edge is a right angle.

33. The method of claim 26, wherein the connector is adapted to attach conductors ranging in cross-sectional area from a first, smaller area to a second, larger area, and wherein the larger area is more than 40% larger than the smaller area.

34. The method of claim 33, wherein the larger area is more than 75% larger than the smaller area.

35. The method of claim 34, wherein the larger area is more than 100% larger than the smaller area.

36. The method of claim 35, wherein the larger area is more than 150% larger than the smaller area.

37. The method of claim 36, wherein the larger area is more than 300% larger than the smaller area.

38. The method of claim 26, wherein a thickness of the first wall portion is at least 50% less than a thickness of the second wall portion.

39. The method of claim 26, wherein the thickness of the first wall portion at points beyond the groove is less than the thickness of the second wall portion along the entire length of the central bore.

40. A conductor connector comprising a body defining a central bore extending from a first end of the body, the body including a curved top region, a curved bottom region, a pair of side regions extending between the curved top region and the curved bottom region, and at least one groove formed within at least one of the side regions, wherein the groove includes a bottom edge, two opposite side edges, and an open top, with each side edge being defined by a first end at the bottom edge and a second end, and the open top being defined by the intersection of the second end of each side edge with the side region, and wherein the thicknesses of the side regions beyond the at least one groove for a distance longer than a width of the groove around the circumference of the connector body are constant and less than the thickness of at least one of the top region and the bottom region.

41. A method of terminating or splicing a first conductor to a second conductor comprising:

providing a connector comprising a body defining a central bore extending from a first end of the body, the body including a curved top region, a curved bottom region, and a pair of side regions extending between the top region and the bottom region, and at least one groove formed within at least one of the side regions, wherein the at least one groove includes a bottom edge, two opposite side edges, and an open top, with each side edge being defined by a first end at the bottom edge and a second end, and the open top being defined by the intersection of the second end of each side edge with the side region, and wherein the thicknesses of the side regions beyond the at least one groove for a distance longer than a width of the groove around the circumference of the connector body are constant and less than the thickness of at least one of the top region and the bottom region;

providing a first conductor;

providing a second conductor;

inserting the first conductor into the central bore at the first end of the body;

inserting the second conductor into the central bore at a second end of the body; and crimping the connector to the conductors.

* * * * *